US010837643B2

(12) United States Patent
Pal et al.

(10) Patent No.: US 10,837,643 B2
(45) Date of Patent: Nov. 17, 2020

(54) MIXER ASSEMBLY FOR A COMBUSTOR

(71) Applicant: General Electric Company, Schenectady, NY (US)

(72) Inventors: Sibtosh Pal, Mason, OH (US); Clayton Stuart Cooper, Loveland, OH (US); Arthur Wesley Johnson, Cincinnati, OH (US); Steven Clayton Vise, Loveland, OH (US); Michael Anthony Benjamin, Cincinnati, OH (US); Allen Michael Danis, Mason, OH (US)

(73) Assignee: General Electric Company, Schenectady, NY (US)

( * ) Notice: Subject to any disclaimer, the term of this patent is extended or adjusted under 35 U.S.C. 154(b) by 216 days.

(21) Appl. No.: 16/055,494

(22) Filed: Aug. 6, 2018

(65) Prior Publication Data

US 2020/0041129 A1 Feb. 6, 2020

(51) Int. Cl.

| | |
|---|---|
| ***F23R 3/14*** | (2006.01) |
| ***F23R 3/28*** | (2006.01) |
| ***F23C 7/00*** | (2006.01) |

(52) U.S. Cl.

CPC ..... *F23R 3/286* (2013.01); *F23C 7/004* (2013.01); *F23R 3/14* (2013.01)

(58) Field of Classification Search

CPC .. F23R 3/286; F23R 3/14; F23C 7/004; F23D 11/383

See application file for complete search history.

(56) References Cited

U.S. PATENT DOCUMENTS

| | | | | |
|---|---|---|---|---|
| 5,996,352 | A | 12/1999 | Coughlan et al. | |
| 6,134,780 | A | 10/2000 | Coughlan et al. | |
| 6,599,121 | B2 | 7/2003 | Gutmark et al. | |
| 8,007,273 | B2 | 8/2011 | Ruck et al. | |
| 8,066,509 | B2 | 11/2011 | Eroglu et al. | |
| 2004/0050063 | A1* | 3/2004 | Schmotolocha | F23C 7/006 60/767 |
| 2007/0137171 | A1* | 6/2007 | Chapin | F02K 7/02 60/39.76 |
| 2008/0041060 | A1* | 2/2008 | Nilsson | F23R 3/20 60/737 |
| 2008/0110173 | A1* | 5/2008 | Bunker | F23D 14/62 60/737 |
| 2009/0025395 | A1* | 1/2009 | Nilsson | F23C 7/004 60/748 |

(Continued)

FOREIGN PATENT DOCUMENTS

| | | | |
|---|---|---|---|
| CN | 101893244 | A | 11/2010 |
| CN | 103822227 | A | 5/2014 |

(Continued)

OTHER PUBLICATIONS

Chinese Search Report and Office Action Corresponding to Application No. 201910722218 dated Jun. 19, 2020.

*Primary Examiner* — Gerald L Sung

(74) *Attorney, Agent, or Firm* — Dority & Manning, P.A.

(57) ABSTRACT

A mixer assembly for a turbine engine is generally provided. The mixer assembly includes a vane assembly including a plurality of vanes configured to direct a flow of oxidizer to mix with a flow of fuel. The vane assembly includes a fluid diode disposed within a vane flow path between each pair of vanes of the vane assembly.

19 Claims, 7 Drawing Sheets

(56) References Cited

U.S. PATENT DOCUMENTS

| | | | | |
|---|---|---|---|---|
| 2010/0074757 | A1* | 3/2010 | Headland | F23R 3/286<br>416/227 R |
| 2010/0293952 | A1 | 11/2010 | Jain et al. | |
| 2012/0017595 | A1* | 1/2012 | Liu | F23D 14/02<br>60/737 |
| 2012/0285173 | A1* | 11/2012 | Poyyapakkam | F23R 3/14<br>60/772 |
| 2012/0324860 | A1* | 12/2012 | Shimo | F23R 7/00<br>60/39.76 |
| 2013/0255261 | A1* | 10/2013 | Abdelnabi | F23R 3/286<br>60/734 |
| 2014/0137561 | A1 | 5/2014 | Crothers et al. | |
| 2017/0051919 | A1 | 2/2017 | Dolmansley | |
| 2017/0184309 | A1* | 6/2017 | Turrini | F23R 3/286 |
| 2017/0227226 | A1 | 8/2017 | Max et al. | |
| 2017/0227227 | A1 | 8/2017 | Kleinfeld et al. | |
| 2018/0045414 | A1 | 2/2018 | Sadasivuni | |
| 2019/0086090 | A1* | 3/2019 | Dolmansley | F23C 7/004 |

FOREIGN PATENT DOCUMENTS

| | | | |
|---|---|---|---|
| EP | 0762057 | A1 | 3/1997 |
| EP | 1070915 | A1 | 1/2001 |
| EP | 2169304 | A1 | 3/2010 |

* cited by examiner

MIXER ASSEMBLY FOR A COMBUSTOR

FIELD

The present subject matter relates generally to combustor assemblies for turbo machines. More specifically, the present subject matter relates to mixer assemblies for turbo machine combustor assemblies.

BACKGROUND

Turbo machines, such as gas turbine engines, include combustor assemblies configured to provide an efficient mixing of fuel and air to produce combustion gases and operate the turbo machine. Combustor assemblies may be configured with rich-burn combustors that include swirlers integrated with fuel nozzles to deliver a swirled fuel/air mixture to the combustion chamber. Conventional swirler designs include multiple swirl passages producing a co-swirl or a counter-swirl. Swirlers generally exhibit a swirler tone frequency and a processing frequency. The swirler tone frequency, manifested by mass flowrate oscillations through the swirler vanes, can result in undesired dynamics, such as acoustics, pressure oscillations, noise, or vibrations. Furthermore, fuel spray through the swirler is modulated and results in periodic heat release that can couple with natural frequencies of the combustor to result in undesired combustion dynamics. Such combustion dynamics can result in damage to the combustor assembly, or components thereof, or loss of efficiency, operability, or performance, or increased damage to the turbo machine.

There is a need for a combustor assembly, or components thereof, that mitigate or eliminate frequency coupling that may result in undesired combustion dynamics that deteriorate the combustor assembly or turbo machine.

BRIEF DESCRIPTION

Aspects and advantages of the invention will be set forth in part in the following description, or may be obvious from the description, or may be learned through practice of the invention.

An aspect of the present disclosure is directed to a mixer assembly for a turbine engine. The mixer assembly includes a vane assembly including a plurality of vanes configured to direct a flow of oxidizer to mix with a flow of fuel. The vane assembly includes a fluid diode disposed within a vane flow path between each pair of vanes of the vane assembly.

In one embodiment, the fluid diode comprises a first wall extended inward toward a vane flow path centerplane from an upstream to a downstream end.

In various embodiments, the fluid diode comprises a convergent-divergent nozzle extended within the vane flow path. In one embodiment, the convergent-divergent nozzle includes a first wall extended inward toward a vane flow path center plane. The first wall extended toward the vane flow path center plane at a downstream end of the first wall relative to an upstream end of the first wall. A second wall is extended from the first wall toward the vane. The second wall is extended toward the vane at a downstream end of the second wall relative to an upstream end of the second wall coupled to the first wall.

In still various embodiments, the vane assembly includes a plurality of vanes disposed in circumferential arrangement around a longitudinal axis. Each vane is disposed between a surrounding wall. Each pair of vanes and the surrounding wall together define the vane flow path therebetween. In one embodiment, the fluid diode is defined at the vane. In another embodiment, the fluid diode is defined at the surrounding wall. In still another embodiment, the vane flow path defines a cross sectional area. The fluid diode extends from one or more of the vane or the surrounding wall to within 50% of the vane flow path cross sectional area.

In one embodiment, the fluid diode defines a waveform.

In various embodiments, the fluid diode defines a concave structure. In one embodiment, a first wall of the fluid diode is defined concave. A second wall of the fluid diode is extended from the first wall toward a downstream end of the vane flow path.

In still various embodiments, the fluid diode includes a pair or more of first wall extended toward a vane flow path centerplane. The fluid diode further includes a second wall extended between the pair or more of first wall and coupled thereto. In one embodiment, the first wall is extended between a pair of vanes. In another embodiment, the first wall is extended between a pair of surrounding walls.

Another aspect of the present disclosure is directed to a fuel injector. The fuel injector includes a mixer assembly surrounding a fuel passage. The mixer assembly includes a vane assembly including a plurality of vanes configured to direct a flow of oxidizer to mix with a flow of fuel from the fuel passage. The vane assembly includes a fluid diode disposed within a vane flow path between each pair of vanes of the vane assembly. In one embodiment, the fluid diode of the mixer assembly includes a convergent-divergent nozzle extended within the vane flow path. In another embodiment, the fluid diode of the mixer assembly includes a pair or more of first wall extended toward a vane flow path centerplane. The fluid diode includes a second wall extended between the pair or more of first wall and coupled thereto.

An aspect of the present disclosure is further directed to a turbine engine. The turbine engine includes a combustor assembly that includes a mixer assembly. The mixer assembly includes a plurality of vanes disposed in circumferential arrangement around a longitudinal axis. The plurality of vanes is disposed between a surrounding wall. Each pair of vanes and the surrounding wall together define a vane flow path therebetween. A fluid diode is disposed within the vane flow path.

In one embodiment of the turbine engine, the fluid diode of the mixer assembly includes a convergent-divergent nozzle extended within the vane flow path from one or more of the vane or the surrounding wall.

In another embodiment of the turbine engine, the fluid diode of the mixer assembly includes a pair or more of first wall extended toward a vane flow path centerplane. The fluid diode includes a second wall coupled to the pair or more of first wall at an upstream end of the first wall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
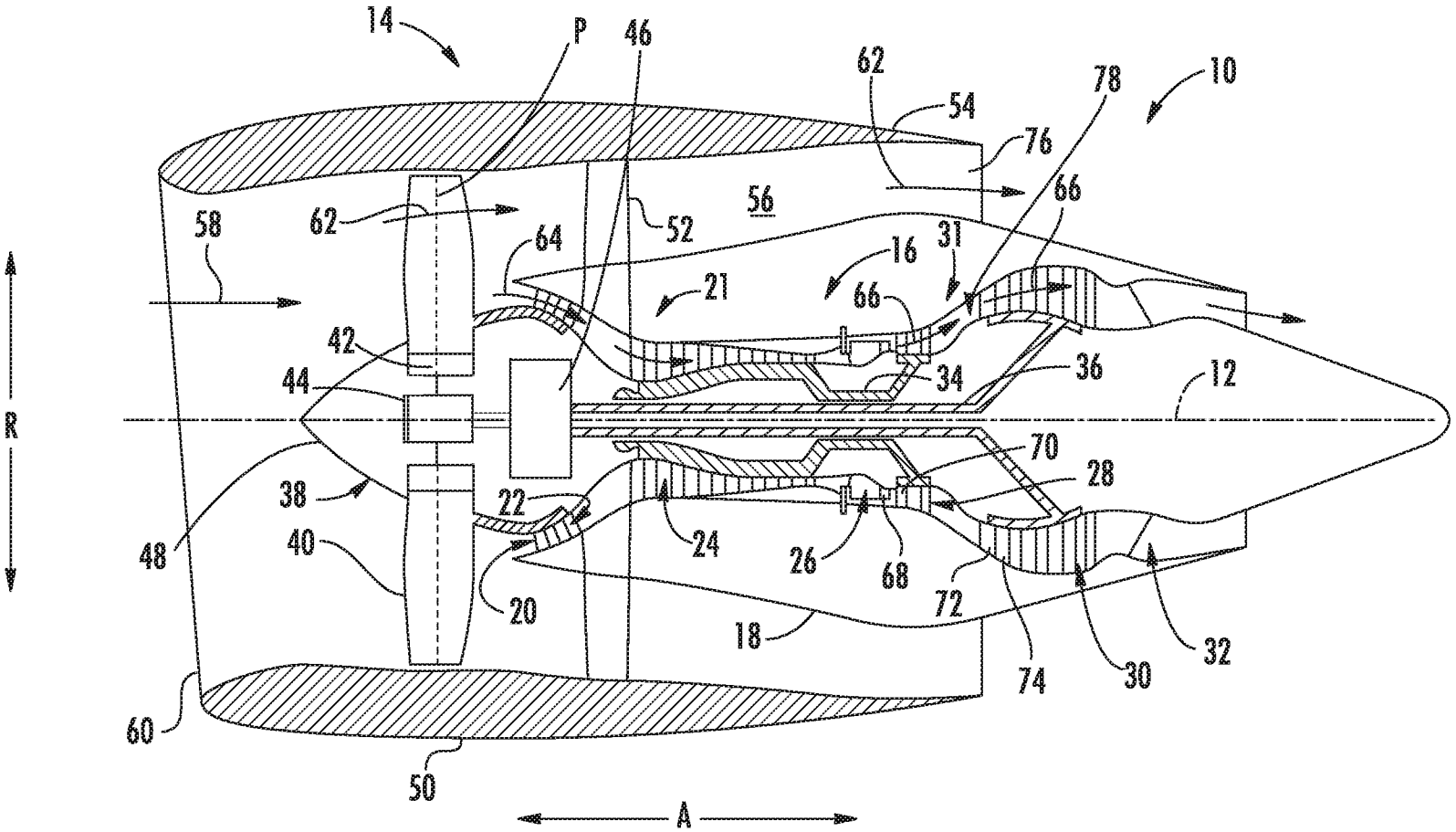
FIG. 1 is a schematic, cross-sectional view of an exemplary embodiment of a turbo machine engine according to various embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Embodiments of a combustor assembly for a turbo machine are generally provided that includes fluid diodes at mixer assemblies that may minimize or eliminate undesired frequency coupling at a swirler, thereby mitigating or eliminating undesired combustion dynamics and improving performance, operability, or durability of the combustor assembly and turbo machine. Embodiments of the combustor assembly and turbo machine described herein include mixer assemblies with integrated fluid diodes that may damp the swirler tone frequency. The fluid diode at the mixer assembly shown and described herein may minimize or eliminate communication between the upstream flow and the within-mixer assembly and downstream flow, thereby mitigating or eliminating low frequency growl and high frequency pressure oscillations from the combustor assembly.

Referring now to the drawings, wherein identical numerals indicate the same elements throughout the figures, FIG. 1 is a schematic cross-sectional view of a turbo machine in accordance with an exemplary embodiment of the present disclosure. More particularly, for the embodiment of FIG. 1, the turbo machine defines a gas turbine engine 10, referred to herein as "engine 10." As shown in FIG. 1, the engine 10 defines an axial direction A (extending parallel to a longitudinal centerline 12 provided for reference) and a radial direction R.

In general, the engine 10 includes a fan section 14 and a core engine 16 disposed downstream from the fan section 14. The exemplary core engine 16 depicted generally includes a substantially tubular outer casing 18 that defines an annular inlet 20. The outer casing 18 encases, in serial flow relationship, a compressor section 21 including a booster or low pressure (LP) compressor 22 and a high pressure (HP) compressor 24; a combustion section 26; a turbine section 31 including a high pressure (HP) turbine 28 and a low pressure (LP) turbine 30; and a jet exhaust nozzle section 32. A high pressure (HP) shaft 34 drivingly connects the HP turbine 28 to the HP compressor 24, together defining a HP spool. A low pressure (LP) shaft 36 drivingly connects the LP turbine 30 to the LP compressor 22, together defining an LP spool. It should be appreciated that other embodiments of the engine 10 not depicted may further an intermediate pressure (IP) spool defined by an IP compressor drivingly connected to an IP turbine via an IP shaft, in which the IP spool is disposed in serial flow relationship between the LP spool and the HP spool.

For the embodiment depicted, the fan section 14 includes a variable pitch fan 38 having a plurality of fan blades 40 coupled to a disk 42 in a spaced apart manner. As depicted, the fan blades 40 extend outwardly from the disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, disk 42, and actuation member 44 are together rotatable about the longitudinal axis 12 by LP shaft 36 across a power gear assembly 46. The power gear assembly 46 includes a plurality of gears for providing a different rotational speed of the fan section 14 relative to the LP shaft 36, such as to enable a more efficient fan speed and/or LP spool rotational speed.

Referring still to the exemplary embodiment of FIG. 1, the disk 42 is covered by rotatable spinner cap 48 aerodynamically contoured to promote an airflow through the plurality of fan blades 40. Additionally, the exemplary fan section 14 includes a fan casing or outer nacelle 50 that circumferentially surrounds the fan 38 and/or at least a portion of the core engine 16. It should be appreciated that the nacelle 50 may be configured to be supported relative to the core engine 16 by a plurality of circumferentially-spaced outlet guide vanes 52. Moreover, a downstream section 54 of the nacelle 50 may extend over an outer portion of the core engine 16 so as to define a bypass airflow passage 56 therebetween.

During operation of the engine 10, a volume of air 58 enters the turbofan 10 through an associated inlet 60 of the nacelle 50 and/or fan section 14. As the volume of air 58 passes across the fan blades 40, a first portion of the air 58 as indicated by arrows 62 is directed or routed into the bypass airflow passage 56 and a second portion of the air 58 as indicated by arrow 64 is directed or routed into the LP compressor 22. The ratio between the first portion of air 62 and the second portion of air 64 is commonly known as a bypass ratio. The pressure of the second portion of air 64 is then increased as it is routed through the high pressure (HP) compressor 24 and into the combustion section 26, where it is mixed with a liquid and/or gaseous fuel and burned to produce combustion gases 66.

The combustion gases 66 are routed through the HP turbine 28 where a portion of thermal and/or kinetic energy from the combustion gases 66 is extracted via sequential stages of HP turbine stator vanes 68 that are coupled to the outer casing 18 and HP turbine rotor blades 70 that are coupled to the HP shaft 34, thus causing the HP shaft to rotate, thereby supporting operation of the HP compressor 24. The combustion gases 66 are then routed through the LP turbine 30 where a second portion of thermal and kinetic energy is extracted from the combustion gases 66 via sequential stages of LP turbine stator vanes 72 that are coupled to the outer casing 18 and LP turbine rotor blades 74 that are coupled to the LP shaft 36, thus causing the LP shaft or spool 36 to rotate, thereby supporting operation of the LP compressor 22 and/or rotation of the fan 38.

The combustion gases 66 are subsequently routed through the jet exhaust nozzle section 32 of the core engine 16 to provide propulsive thrust. Simultaneously, the pressure of the first portion of air 62 is substantially increased as the first portion of air 62 is routed through the bypass airflow passage 56 before it is exhausted from a fan nozzle exhaust section 76 of the turbofan 10, also providing propulsive thrust. The HP turbine 28, the LP turbine 30, and the jet exhaust nozzle section 32 at least partially define a hot gas path 78 for routing the combustion gases 66 through the core engine 16.

It should be appreciated, however, that the exemplary engine 10 depicted in FIG. 1 is by way of example only, and that in other exemplary embodiments, the engine 10 may have any other suitable configuration, such as, but not limited to, turboprop, turboshaft, turbojet, or prop-fan configurations for aviation, marine, or power generation purposes. Still further, other suitable configurations may include steam turbine engines or other Brayton cycle machines.

Figure 2:
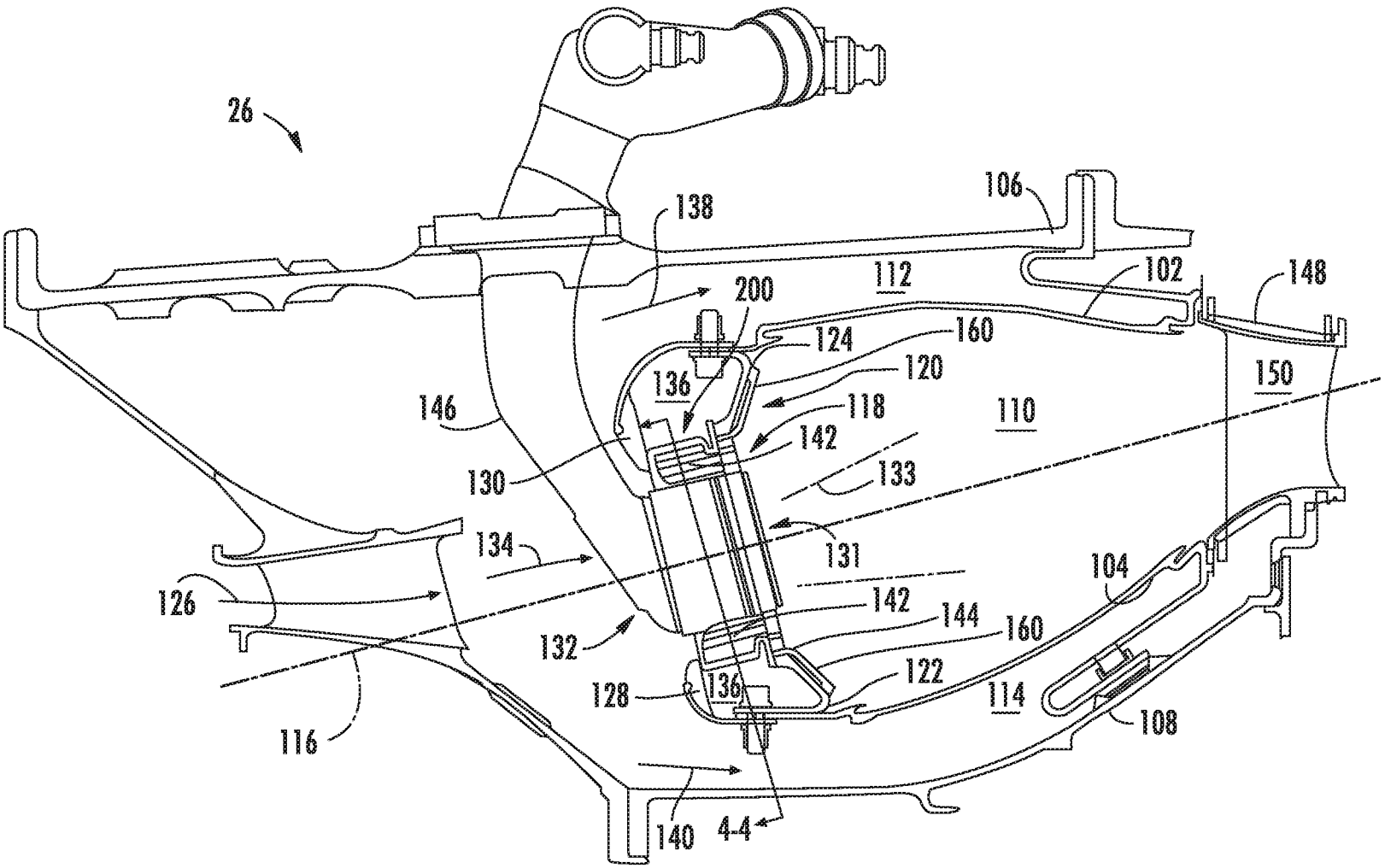
FIG. 2 is a schematic, cross-sectional view of an exemplary embodiment of a combustion section of the engine shown in FIG. 1.

Referring now to FIG. 2, a schematic cross-sectional view of one exemplary embodiment of a combustion section 26 suitable for use within the engine 10 described above is generally provided. In the exemplary embodiment, the combustion section 26 includes an annular combustor. Exemplary embodiments may define a rich burn or lean burn combustion section 26. Additionally, or alternatively, one skilled in the art will appreciate that the combustor may be any other combustor, including, but not limited to, a single or double annular combustor, a can-combustor, or a can-annular combustor.

As shown in FIG. 2, combustion section 26 includes an outer liner 102 and an inner liner 104 disposed between an outer combustor casing 106 and an inner combustor casing 108. Outer and inner liners 102 and 104 are spaced radially from each other such that a combustion chamber 110 is defined therebetween. Outer liner 102 and outer casing 106 form an outer passage 112 therebetween, and inner liner 104 and inner casing 108 form an inner passage 114 therebetween. Combustion section 26 also includes a longitudinal axis 116 which extends from a forward end to an aft end of the combustion section 26 as shown in FIG. 2.

The combustion section 26 may also include a combustor assembly 118 comprising an annular dome 120 mounted upstream of the combustion chamber 110 that is configured to be coupled to the forward ends of the outer and inner liners 102, 104. More particularly, the combustor assembly 118 includes an inner annular dome 122 attached to the forward end of the inner liner 104 and an outer annular dome 124 attached to the forward end of the outer liner 102.

As shown in FIG. 2, the combustion section 26 may be configured to receive an annular stream of pressurized compressor discharge air 126 from a discharge outlet of the high pressure compressor 24. To assist in directing the compressed air, the annular dome 120 may further comprise an inner cowl 128 and an outer cowl 130 which may be coupled to the upstream ends of inner and outer liners 104 and 102, respectively. In this regard, an annular opening 132 formed between inner cowl 128 and outer cowl 130 enables compressed fluid to enter combustion section 26 through a diffuse opening in a direction generally indicated by arrow 134. The compressed air may enter into a first cavity 136 defined at least in part by the annular dome 120. As will be discussed in more detail below, a portion of the compressed air in the first cavity 136 may be used for combustion, while another portion may be used for cooling the combustion section 26.

In addition to directing air into first cavity 136 and the combustion chamber 110, the inner and outer cowls 128, 130 may direct a portion of the compressed air around the outside of the combustion chamber 110 to facilitate cooling liners 102 and 104. For example, as shown in FIG. 2, a portion of the compressor discharge air 126 may flow around the combustion chamber 110, as indicated by arrows 138 and 140, to provide cooling air to outer passage 112 and inner passage 114, respectively.

In certain exemplary embodiments, the inner dome 122 may be formed integrally as a single annular component, and similarly, the outer dome 124 may also be formed integrally as a single annular component. It should be appreciated, however, that in other exemplary embodiments, the inner dome 122 and/or the outer dome 124 may alternatively be formed by one or more components joined in any suitable manner. For example, with reference to the outer dome 124, in certain exemplary embodiments, the outer cowl 130 may be formed separately from the outer dome 124 and attached to the forward end of the outer dome 124 using, e.g., a welding process, a mechanical fastener, a bonding process or adhesive, or a composite layup process. Additionally, or alternatively, the inner dome 122 may have a similar configuration.

In one embodiment, the combustor assembly 118 further includes a plurality of mixer assemblies 142 spaced along a circumferential direction between the outer annular dome 124 and the inner dome 122. In this regard, a plurality of circumferentially-spaced contoured cups 144 may be formed in the annular dome 120, and each cup 144 defines an opening in which a swirler, cyclone, or mixer assembly 142 is mounted for introducing the air/fuel mixture into the combustion chamber 110. Notably, compressed air may be directed from the combustion section 26 into or through one or more of the mixer assemblies 142 to support combustion in the upstream end of the combustion chamber 110.

Figure 3:
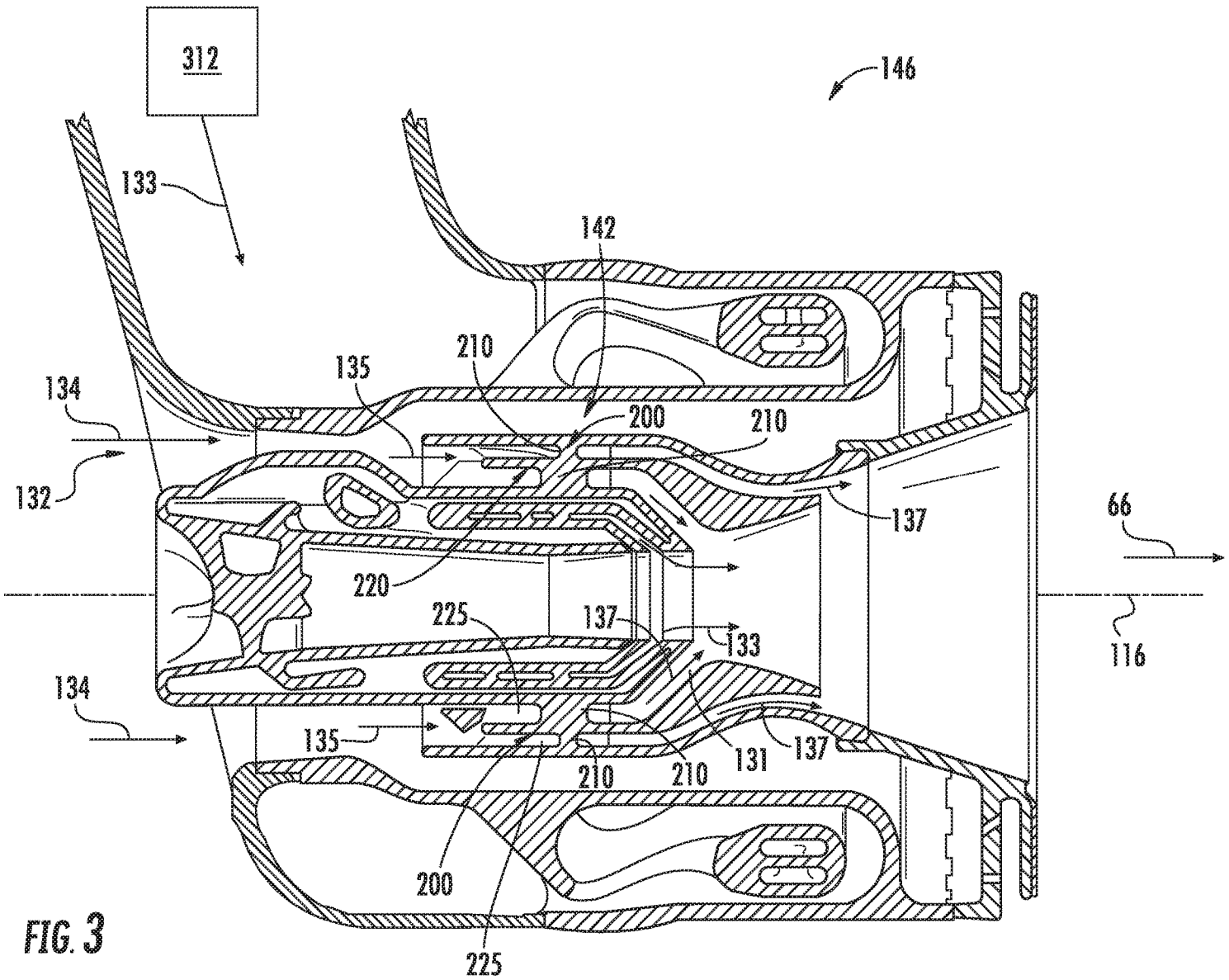
FIG. 3 is a schematic, cross-sectional view of an exemplary fuel injector of the combustion section of FIG. 2 including a mixer assembly.

Referring now to FIG. 3, a cross-sectional view of a portion of an exemplary fuel injector 146 of the combustion section 26 is generally provided. Referring to FIGS. 2-3, a liquid and/or gaseous fuel 133 is transported to the combustion section 26 by a fuel distribution system 312, where it is introduced at the front end of a burner in a highly atomized spray from the fuel nozzle. In an exemplary embodiment generally depicted in regard to FIG. 2, each mixer assembly 142 may define an opening for receiving a fuel injector 146 (details are omitted for clarity). The fuel injector 146 may inject fuel in an axial direction (i.e., along longitudinal axis 116) as well as in a generally radial direction, where the fuel may be swirled with the incoming compressed air. Thus, each mixer assembly 142 receives compressed air from annular opening 132 and fuel from a corresponding fuel injector 146. Fuel and pressurized air are swirled and mixed together by mixer assemblies 142, and the resulting fuel/air mixture is discharged into combustion chamber 110 for combustion thereof.

In another embodiment, such as generally depicted at the exemplary fuel injector 146 in FIG. 3, the mixer assembly 142 including a vane assembly 200 and a fluid diode 250 (depicted in FIGS. 4-10) may be included at the fuel injector 146. For example, in one embodiment, the mixer assembly 142 may be formed integrally into the fuel injector 146. The mixer assembly 142 within the fuel injector 146 may generally surround a fuel passage 131 through which one or more flows of fuel 133 may egress. The flow of fuel 133 is mixed and burned with oxidizer 137 egressing the mixer assembly 142 and then burned to form combustion gases 66.

The combustion section 26 may further comprise an ignition assembly (e.g., one or more igniters extending through the outer liner 102) suitable for igniting the fuel-air mixture. However, details of the fuel injectors and ignition assembly are omitted in FIG. 2 for clarity. Upon ignition, the resulting combustion gases may flow in a generally axial direction (along longitudinal axis 116) through the combustion chamber 110 into and through the turbine section of the engine 10 where a portion of thermal and/or kinetic energy from the combustion gases is extracted via sequential stages of turbine stator vanes and turbine rotor blades. More specifically, the combustion gases may flow into an annular, first stage turbine nozzle 148. As is generally understood, the nozzle 148 may be defined by an annular flow channel that includes a plurality of radially-extending, circularly-spaced nozzle vanes 150 that turn the gases so that they flow angularly and impinge upon the first stage turbine blades (not shown) of the HP turbine 28 (FIG. 1).

Referring to FIG. 2, the plurality of mixer assemblies 142 are placed circumferentially within the annular dome 120 around the engine 10. In one embodiment, such as shown in FIG. 2, fuel injectors 146 are disposed in each mixer assembly 142 to provide fuel and support the combustion process. In another embodiment, the mixer assembly 142 is defined within the fuel injector 146, such as shown in FIG. 3. Referring back to FIG. 2, each dome has a heat shield, for example, a deflector plate 160, which thermally insulates the annular dome 120 from the extremely high temperatures generated in the combustion chamber 110 during engine operation. The inner and outer annular domes 122, 124 and the deflector plate 160 may define a plurality of openings (e.g., contoured cups 144) for receiving the mixer assemblies 142. As shown the plurality of openings are, in one embodiment, circular. However, it should be appreciated that in other embodiments, the openings are ovular, elliptical, polygonal, oblong, or other non-circular cross sections.

Compressed air (e.g., 126) flows into the annular opening 132 where a portion of the air 126 will be used to mix with fuel for combustion and another portion will be used for cooling the dome deflector plate 160. Compressed air may flow around the fuel injector 146 and through the mixing vanes around the circumference of the mixing assemblies 142, where compressed air is mixed with fuel and directed into the combustion chamber 110. Another portion of the air enters into a cavity 136 defined by the annular dome 120 and the inner and outer cowls 128, 130. The compressed air in cavity 136 is used, at least in part, to cool the annular dome 120 and the deflector plate 160.

Figure 4:
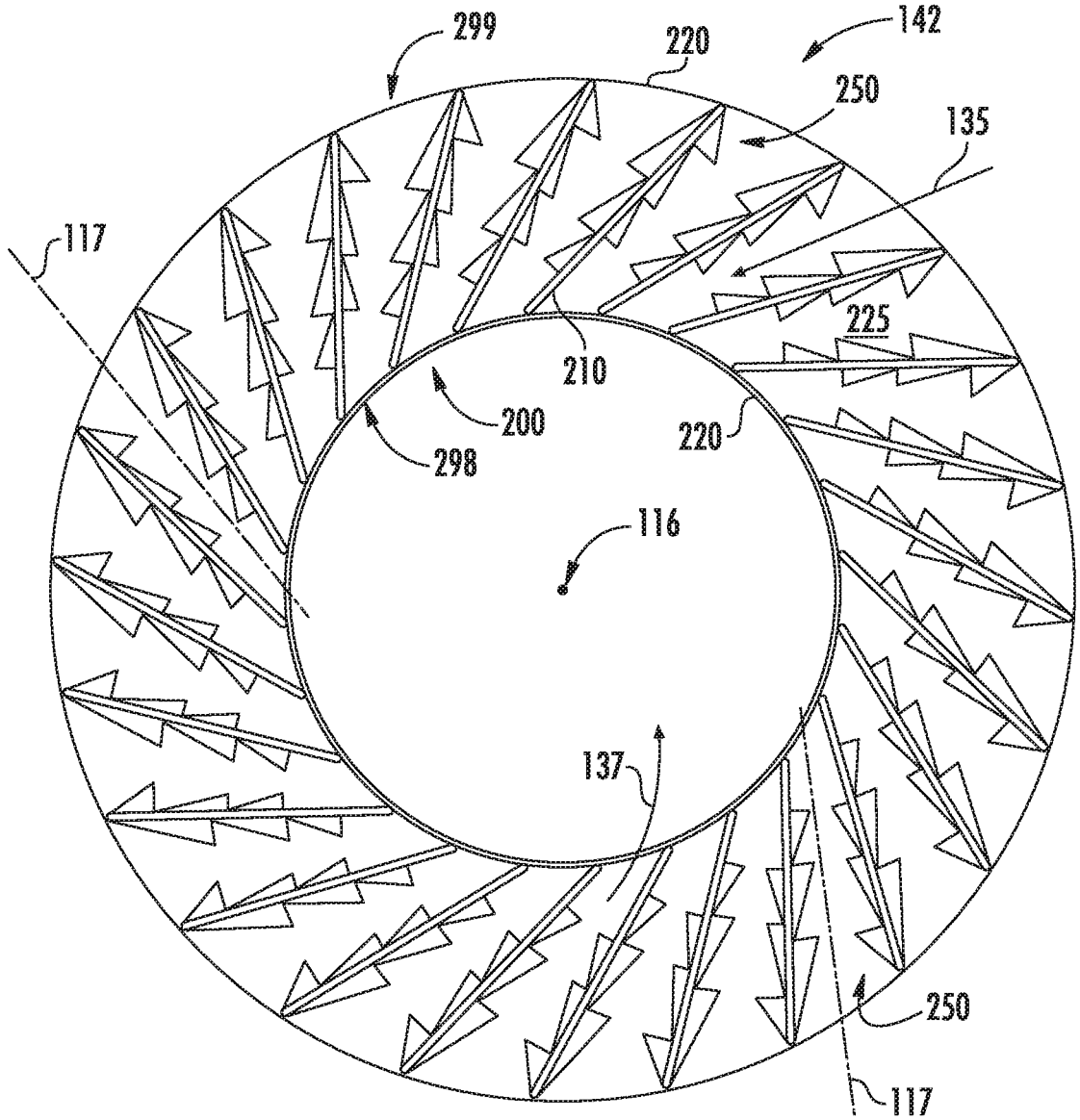
FIG. 4 is an exemplary cross sectional view of a portion of an exemplary mixer assembly of the combustion section of FIG. 2.

Referring now to FIGS. 2-10, exemplary embodiments of the mixer assembly 142 are generally provided. The mixer assembly 142 includes a vane assembly 200 including a plurality of vanes 210 configured to direct a flow of oxidizer 135 therethrough to mix with a flow of fuel from the fuel injector 146 (FIG. 2). Referring to FIGS. 2-4, the mixer assembly 142 includes the plurality of vanes 210 of the vane assembly 200 disposed in circumferential arrangement around longitudinal axis 116. In one embodiment, the vanes 210 are defined in circumferential arrangement around the fuel injector 146, such as depicted in regard to FIG. 2. In another embodiment, the vanes 210 are defined in circumferential arrangement around or between fuel passages 131 (FIG. 3). Although the vane assembly 200 in FIG. 2 and FIG. 4 depicts a radially oriented plurality of vanes 210, it should be appreciated that in other embodiments the vane assembly 200 may define an axially oriented plurality of vanes 210, such as depicted in regard to FIG. 3. Still further, although the mixer assembly 142 and vane assembly 200 thereof may generally define a separate or separable component from the fuel injector 146 (FIG. 2), it should be appreciated that in other embodiments the mixer assembly 142, or the vane assembly 200 in particular, may be defined as a portion of the fuel injector 146 (FIG. 3).

Each pair of vanes 210 defines a vane flow path 225 therebetween. The vane flow path 225 may further be defined between each pair of vanes 210 and a surrounding wall 220 (depicted in FIG. 7). The flow of oxidizer 135, such as air 134 from the compressor section 21 (FIG. 2), flows through the vane flow paths 225 defined between each pair of vanes 210. The plurality of vanes 200 imparts a swirl to the flow of oxidizer exiting the vane flow path 225, shown schematically by arrows 137. The swirling flow of oxidizer 137 is mixed with liquid or gaseous fuel 133 from the fuel injector 146 (FIG. 3) to provide efficient mixing and burning to produce combustion gases 66 (FIG. 3).

Referring to FIGS. 4-8, the vane assembly 200 includes a fluid diode 250 disposed within the vane flow path 225. In one embodiment, such as generally provided in regard to FIGS. 4-5, the fluid diode 250 includes a first wall 251 extended inward toward a vane flow path centerplane 117 from an upstream end 299 to a downstream end 298. The fluid diode 250 may further include a second wall 252 extended from the first wall 251. In one embodiment, the fluid diode 250 is extended from the vane 210.

Figure 5:
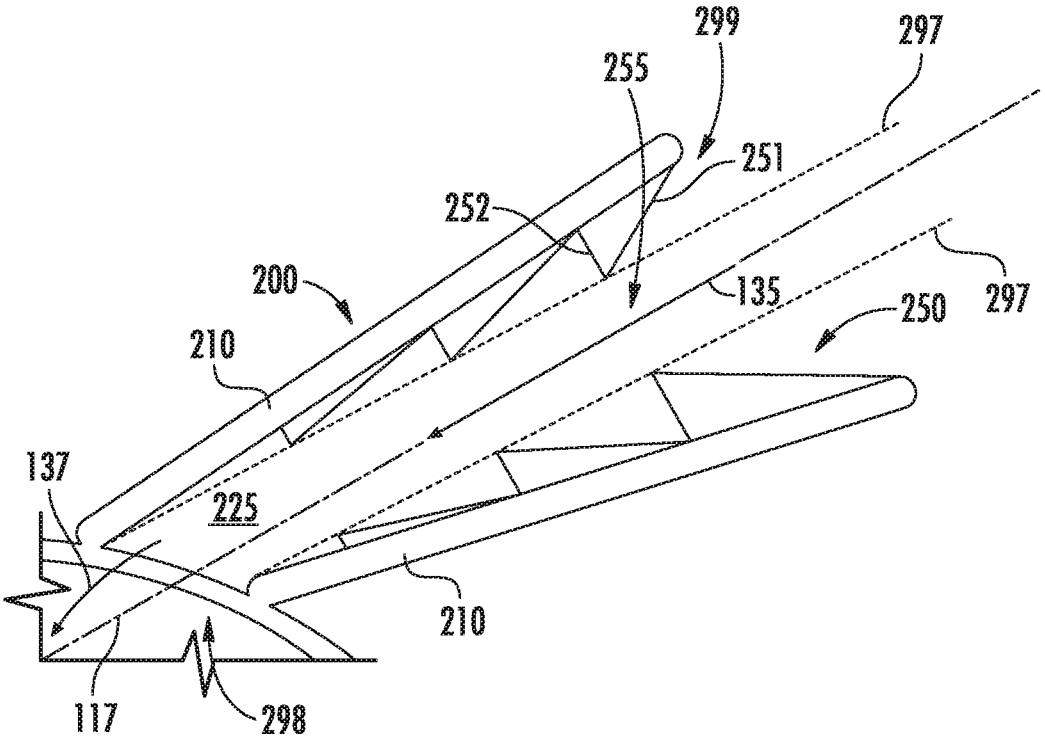
FIGS. 5-6 are exemplary embodiments of a fluid diode at the mixer assembly.

For example, referring to the exemplary close-up view generally provided in FIG. 5, the first wall 251 is extended from the vane 210 inward into the vane flow path 225 toward the vane flow path centerplane 117. The second wall 252 may extend from the first wall 251, such as the downstream end 298 of each first wall 251, to the vane 210. In one embodiment, the vane flow path 225 defines a cross sectional area between each pair of vanes 210 defining the vane flow path 225. The fluid diode 250 is extended from one or more of the vanes 210 within 50% of the vane flow path 225 toward the vane flow path centerplane 117.

As another example, the vane assembly 200 may define a generally decreasing cross sectional area of the vane flow path 225 from the upstream end 299 to the downstream end 298. The fluid diode 250 may extend into the vane flow path 225 substantially equal to or less than the cross sectional area at the downstream end 298, such as generally depicted via reference lines 297 in FIG. 5.

Figure 6:
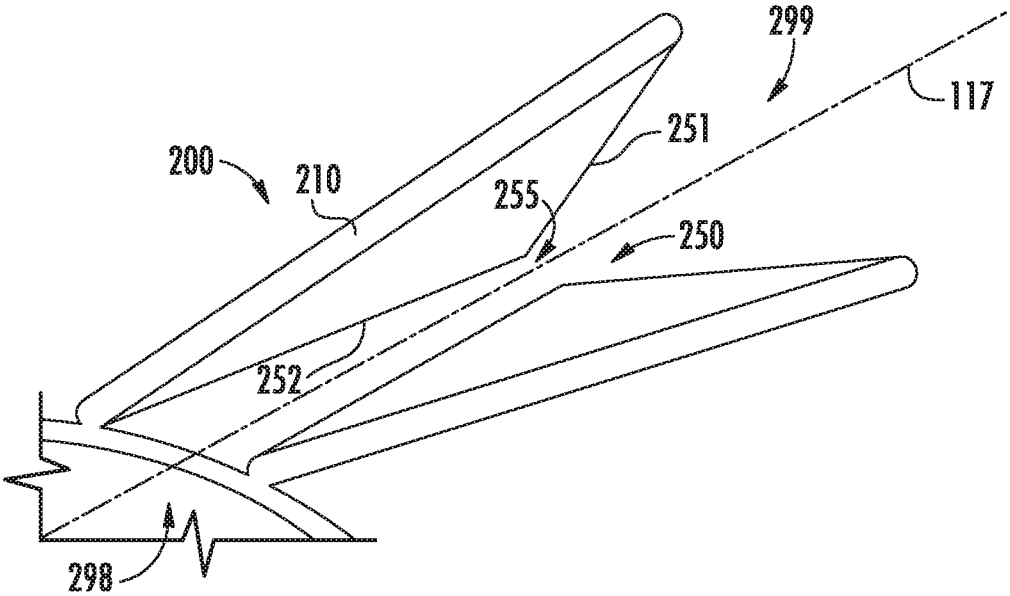

Referring now to FIG. 6, in various embodiments, the fluid diode 250 defines a convergent-divergent nozzle structure within the vane flow path 225. For example, the first wall 251 may be extended inward into the vane flow path 225 toward the vane flow path center plane 117. The downstream end 298 of each first wall 251 is extended toward the vane flow path center plane 117 relative to the upstream end 299 of each first wall 251. As such, the first wall 251 is converging toward the vane flow path centerplane 117. The fluid diode 250 may further include the second wall 252 extended from the first wall 251 toward the vane 210 or away from the vane flow path centerplane 117. The downstream end 298 of the second wall 252 is extended toward the vane 210, such as coupled thereto, relative to the upstream end 299 of the second wall 252 coupled to the first wall 251. As such, the second wall 252 is diverging away from the vane flow path centerplane 117. The convergent-divergent nozzle structure of the fluid diode 250 may define a nozzle 255 between each first wall 251 and second wall 252 extended toward one another from each pair of vanes 210.

Referring to FIGS. 5-6, the first wall 251 and/or the second wall 252 of the fluid diode 250 may extend into the vane flow path 225 such as to permit the flow of oxidizer 135 from the upstream end 299 toward the downstream end 298 to further mix with the fuel from the fuel injector 146 (FIG. 2). The fluid diode 250 is further extended into the vane flow path 225 such as to mitigate or disable back flow or back pressure from the downstream end 298 toward the upstream end 299. For example, the fluid diode 250 may define the nozzle 255 such as to mitigate or disable back flow or back pressure from the downstream end 298 toward the upstream end 299. The fluid diode 250 may mitigate or eliminate the mass flowrate fluctuations through the vane flow paths 225, and thereby the amplitude of the swirler tone frequency.

Figure 7:
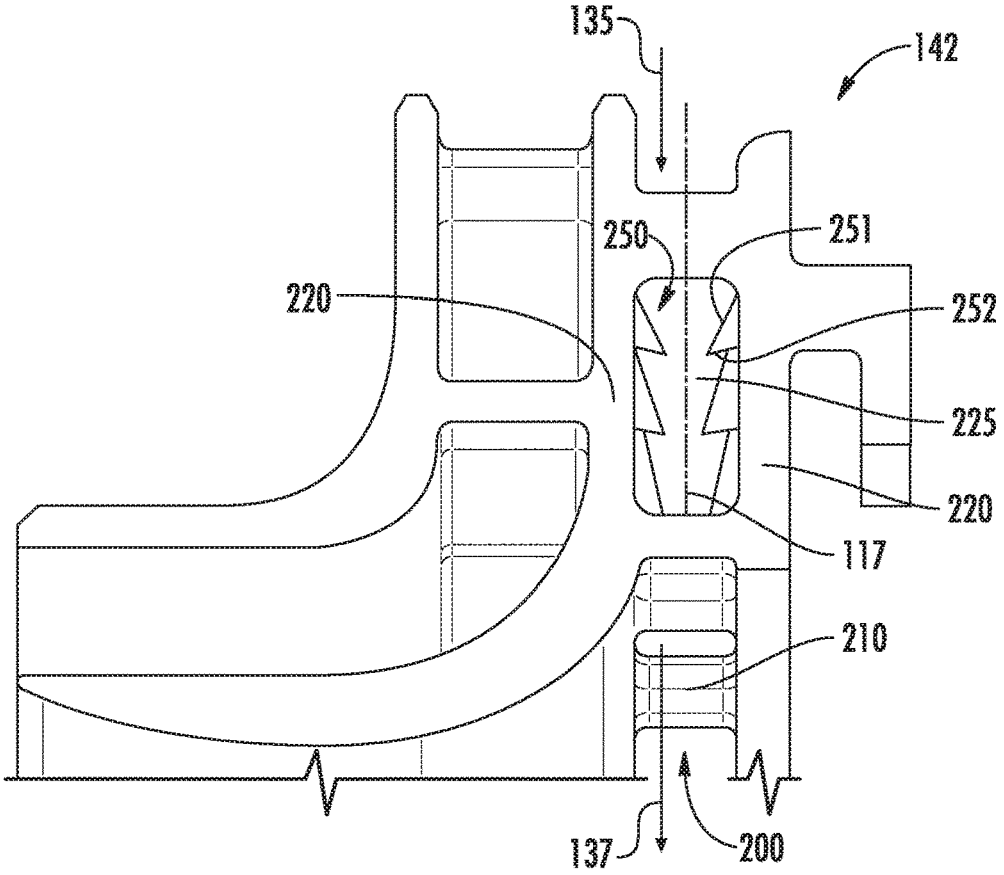
FIG. 7 is a cross sectional view of another embodiment of a portion of an exemplary mixer assembly of the combustion section of FIG. 2.

Referring now to FIG. 7, another exemplary embodiment of a portion of the mixer assembly 142 is generally provided. The mixer assembly 142 including the fluid diode 250 is configured substantially similarly as described in regard to FIGS. 2-6. However, in FIG. 7 the mixer assembly 142 further depicts the surrounding wall 220 between which the plurality of vanes 200 is disposed. For example, the plurality of vanes 220 may be included between a pair of surrounding walls 220. In one embodiment, the fluid diode 250 may extend into the vane flow path 225 from one or more of a pair of the surrounding walls 220, such as generally depicted in regard to FIG. 7. The fluid diode 250 including the first wall 251 and the second wall 252 may be defined into the van flow path 225 such as generally shown and described in regard to FIGS. 4-6.

Figure 8:
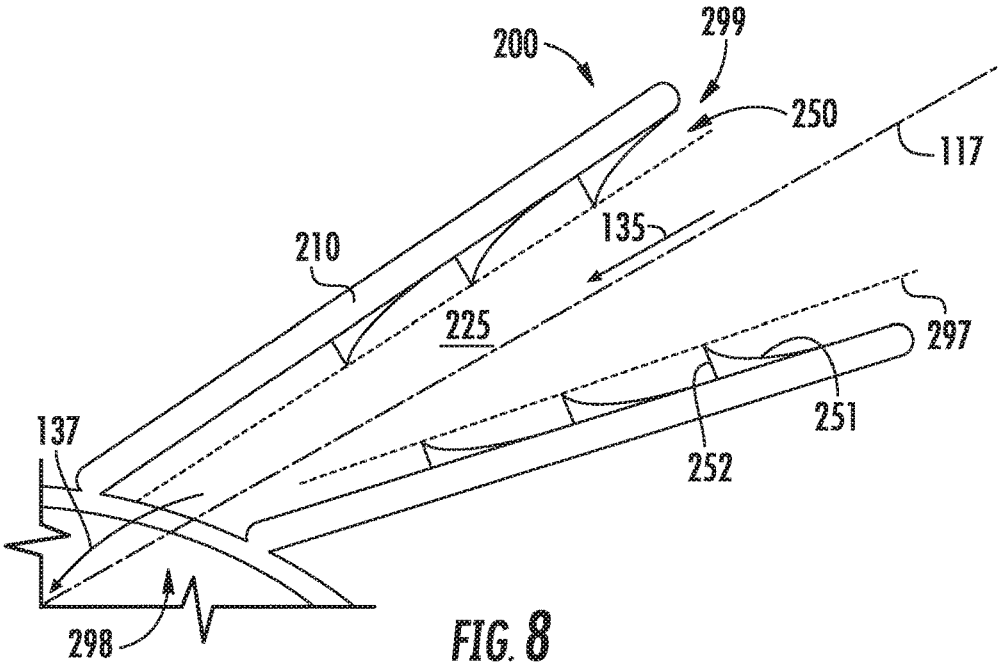
FIGS. 8-10 are further exemplary embodiments of a fluid diode at the mixer assembly.

Referring now to FIG. 8, in one exemplary embodiment, the first wall 251 defines a concave structure. The concave structure of the first wall 251 of the fluid diode 250 is defined relative to the flow of oxidizer 135 from the upstream end 299 toward the downstream end 298. It should be appreciated that in other embodiments not depicted, the second wall 252 may additionally, or alternatively, define the concave structure.

Figure 9:
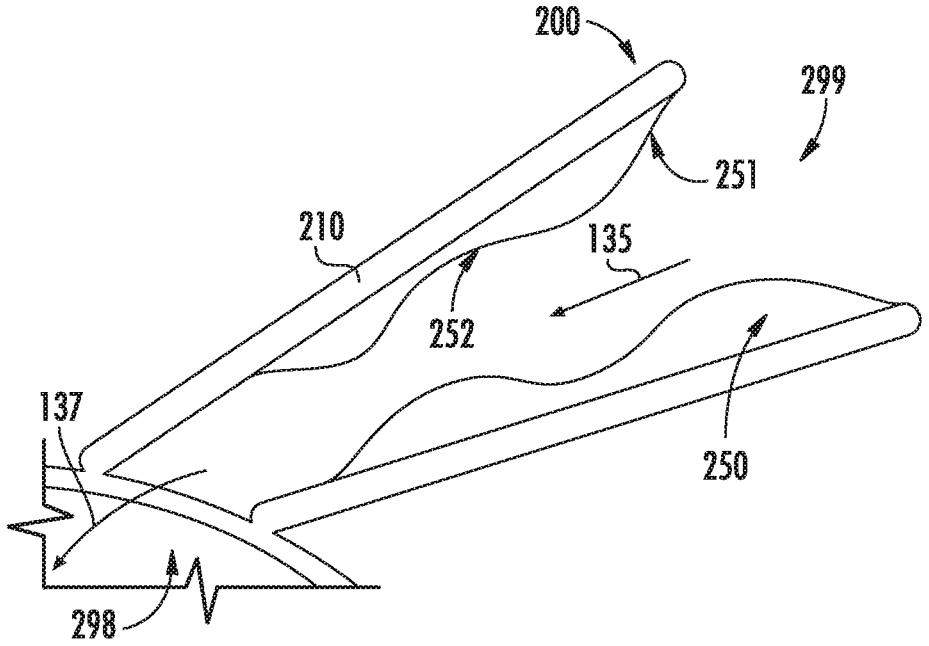

Referring now to FIG. 9, in various exemplary embodiments, the fluid diode 250 defines a waveform. In one embodiment, such as generally depicted in regard to FIG. 8, the fluid diode 250 defining a waveform may define a sinusoidal waveform. However, in other embodiments, such as generally depicted in regard to FIG. 5, the fluid diode 250 may define a triangle waveform. In still other embodiments not depicted, the fluid diode 250 may define a step or box waveform, a sawtooth waveform, or an irregular waveform, or another suitable waveform for mitigating or eliminating back flow or back pressure of the oxidizer 135 toward the upstream end 299 of the vane flow path 225.

Figure 10:
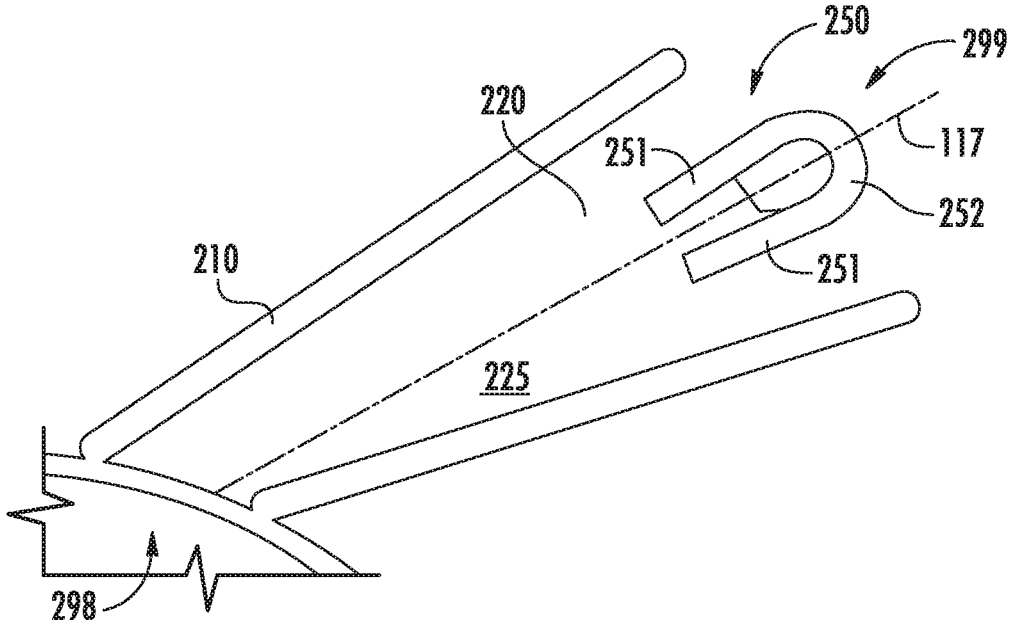

Referring now to FIG. 10, in one embodiment, the fluid diode 250 includes a pair or more of first wall 251 extended toward the vane flow path centerplane 117. The fluid diode 250 may further include the second wall 252 extended between the pair or more of first wall 251 and coupled thereto. For example, the fluid diode 250 may extend from the surrounding wall 220 across a middle portion of the vane flow path 225. In various embodiments, the fluid diode 250 may extend between 25% and 75% of the vane flow path cross sectional area between each pair of vanes 210.

It should be appreciated that various embodiments of the fluid diode 250 shown and described in regard to FIGS. 5-10 may be included in any suitable combination to mitigate or eliminate mass flowrate fluctuations through the vanes flow paths 225, and thereby the amplitude of the swirler tone frequency. For example, the first wall 251 and the second wall 252 of the fluid diode 250 may be extended from the vanes 210, the surrounding walls 220, or another wall or feature defining the vane flow path 225, or combinations thereof. As another example, such combinations may include defining the fluid diode 250 extended from the walls defining the vanes 210 and the surrounding walls 220.

All or part of the combustor assembly 118 including the mixer assembly 142 and the dome 120 may be manufactured by one or more processes or methods known in the art, such as, but not limited to, machining processes, additive manufacturing, layups, casting, or combinations thereof. The combustor assembly 118 may include any suitable material for a combustor assembly 118 for a turbine engine 10, such as, but not limited to, iron and iron-based alloys, steel and stainless steel alloys, nickel and cobalt-based alloys, titanium and titanium-based alloys, ceramic or metal matrix composites, or combinations thereof. All or part of the combustor assembly 118 may be formed as a single, integral piece or a plurality of assembled portions. Such integral pieces may include, but are not limited to, the inner dome 122 and outer dome 124, the outer liner and inner liner 104, the mixer assembly 142, or combinations thereof.

Embodiments of the mixer assembly 142 including the fluid diode 250 may minimize or eliminate undesired frequency coupling at the mixer assembly 142 and combustor assembly 118, thereby mitigating or eliminating undesired combustion dynamics and improving performance, operability, or durability of the combustor assembly 118 and engine 10. Embodiments of the combustor assembly 118 and engine 10 described herein including the mixer assembly 142 may mitigate or eliminate the amplitude of the swirler tone frequency via the fluid diode 250 disposed therebetween within the vane flow path 225. Embodiments of the fluid diode 250 at the mixer assembly 142 shown and described herein may minimize or eliminate communication between the upstream flow 135 and the within-mixer assembly and downstream flow 137, thereby mitigating or eliminating low frequency growl and high frequency pressure oscillations from the combustor assembly 118.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A mixer assembly for a turbine engine, the mixer assembly comprising:

a swirler vane assembly comprising a vane flow path formed by a pair of vanes, wherein the vane flow path is configured to direct a flow of oxidizer to mix with a flow of fuel, and wherein a fluid diode is positioned in the vane flow path, and wherein the fluid diode comprises a first wall and a second wall, wherein the first wall is extended from at least one vane of the pair of vanes inward into the vane flow path, and wherein the first wall forms a decreasing cross-sectional area of the vane flow path from an upstream end of the vane flow path toward a downstream end of the vane flow path, and wherein the second wall forms a blunt body extended from the at least one vane of the pair of vanes respective vane from which the first wall is extended, the second wall formed upstream of a trailing edge of the at least one vane of the pair of vanes.

2. The mixer assembly of claim 1, wherein the first wall is extended inward toward a vane flow path center plane.

3. The mixer assembly of claim 1, wherein the fluid diode comprises an additional fluid diode that comprises a convergent-divergent nozzle extended within the vane flow path.

4. The mixer assembly of claim 3, wherein the convergent-divergent nozzle comprises a third wall and a fourth wall, wherein the third wall is extended toward a vane flow path center plane at the downstream end of the vane flow path relative to the upstream end of the vane flow path.

5. The mixer assembly of claim 1, wherein the swirler vane assembly comprises:

a plurality of the pair of vanes disposed in circumferential arrangement around a longitudinal axis; and a surrounding wall between which each vane of the plurality of pair of vanes is disposed, wherein each pair of vanes of the plurality of the pair of vanes and the surrounding wall together form the vane flow path therebetween.

6. The mixer assembly of claim 5, wherein the fluid diode is defined at the at least one vane.

7. The mixer assembly of claim 5, wherein the fluid diode is defined at the surrounding wall.

8. The mixer assembly of claim 5, wherein the vane flow path defines a cross sectional area between each of the plurality of the pair of vanes, and wherein the fluid diode is extended to within 50% of the cross sectional area of the vane flow path.

9. The mixer assembly of claim 1, wherein the fluid diode defines a waveform.

10. The mixer assembly of claim 1, wherein the fluid diode defines a concave structure.

11. The mixer assembly of claim 10, wherein the first wall of the fluid diode is defined concave, and wherein the second wall of the fluid diode is extended from the first wall toward the downstream end of the vane flow path.

12. The mixer assembly of claim 1, wherein the first wall is extended toward a vane flow path center plane from the at least one vane of the pair of vanes.

13. The mixer assembly of claim 12, wherein the first wall is extended between a pair of surrounding walls.

14. A fuel injector, the fuel injector comprising:

a mixer assembly surrounding a fuel passage, wherein the mixer assembly comprises a swirler vane assembly comprising a vane flow path formed by a pair of vanes, wherein the vane flow path is configured to direct a flow of oxidizer to mix with a flow of fuel from the fuel passage, and wherein a fluid diode is positioned in the vane flow path, and wherein the fluid diode comprises a first wall and a second wall, wherein the first wall is extended from at least one vane of the pair of vanes inward into the vane flow path, and wherein the first wall forms a decreasing cross-sectional area of the vane flow path from an upstream end of the vane flow path toward a downstream end of the vane flow path, and wherein the second wall forms a blunt body extended from the first wall to the at least one vane of the pair of vanes from which the first wall is extended, the second wall formed upstream of a trailing edge of the at least one vane of the pair of vanes.

15. The fuel injector of claim 14, wherein the fluid diode comprises an additional fluid diode that comprises a convergent-divergent nozzle extended within the vane flow path.

16. The fuel injector of claim 14, wherein the first wall is extended toward a vane flow path center plane from the at least one vane of the pair of vanes.

17. A turbine engine, the turbine engine comprising:

a combustor assembly, wherein the combustor assembly comprises a mixer assembly, wherein the mixer assembly comprises a plurality of swirler vanes disposed in circumferential arrangement around a longitudinal axis, and wherein a pair of vanes of the plurality of swirler vanes form a vane flow path therebetween, and wherein a fluid diode is disposed within the vane flow path, and wherein the fluid diode comprises a first wall and a second wall, wherein the first wall is extended from at least one vane of the pair of vanes inward into the vane flow path, and wherein the first wall forms a decreasing cross-sectional area of the vane flow path from an upstream end of the vane flow path toward a downstream end of the vane flow path, and wherein the second wall forms a blunt body extended from the first wall to the at least one vane of the pair of vanes from which the first wall is extended the second wall formed upstream of a trailing edge of the at least one vane of the pair of vanes.

18. The turbine engine of claim 17, wherein the fluid diode comprises an additional fluid diode that comprises a convergent-divergent nozzle extended within the vane flow path.

19. The turbine engine of claim 17, wherein the fluid diode of the mixer assembly comprises a pair or more of the first wall extended toward a vane flow path center plane, and further wherein the fluid diode comprises a pair or more of the second wall coupled to the pair or more of the first wall at an upstream end of the respective first wall.

* * * * *